US010632048B2

(12) United States Patent
Nesmith

(10) Patent No.: US 10,632,048 B2
(45) Date of Patent: Apr. 28, 2020

(54) ORAL WASTE DISPOSAL DEVICE FOR CHEWING TOBACCO

(71) Applicant: Bobby Nesmith, Beach Park, IL (US)

(72) Inventor: Bobby Nesmith, Beach Park, IL (US)

( * ) Notice: Subject to any disclaimer, the term of this patent is extended or adjusted under 35 U.S.C. 154(b) by 127 days.

(21) Appl. No.: 14/789,546

(22) Filed: Jul. 1, 2015

(65) Prior Publication Data

US 2016/0243006 A1 Aug. 25, 2016

Related U.S. Application Data

(60) Provisional application No. 62/119,957, filed on Feb. 24, 2015.

(51) Int. Cl.
*A61J 19/02* (2006.01)
*A61J 19/00* (2006.01)

(52) U.S. Cl.
CPC ..... *A61J 19/02* (2013.01); *A61J 19/00* (2013.01)

(58) Field of Classification Search
CPC ..... A61J 19/00; A61J 19/02; B65D 47/14; A45F 3/16
USPC .... 4/258–259, 274; 222/543, 546, 569–570; 220/375
See application file for complete search history.

(56) References Cited

U.S. PATENT DOCUMENTS 630,225 A * 8/1899 Hodgerney ..... A61J 19/00 4/259
1,012,471 A * 12/1911 Steinke ..... A61J 19/00 4/259
1,796,999 A * 3/1931 Kundt ..... A61J 19/02 4/267
2,301,781 A * 11/1942 Higbee ..... A61J 19/00 200/61.86
2,965,907 A * 12/1960 Ropelato ..... A61J 19/00 222/209
3,235,147 A * 2/1966 Hamilton ..... B65D 47/14 222/543
3,297,192 A * 1/1967 Swett ..... B65D 47/0895 220/838
4,218,787 A * 8/1980 Puckett ..... A61J 19/00 4/258
4,375,705 A * 3/1983 Warax ..... A61J 19/00 4/258
4,520,940 A * 6/1985 Boyd ..... A45F 3/16 220/375

(Continued)

*Primary Examiner* — Tuan N Nguyen
(74) *Attorney, Agent, or Firm* — Michael Best & Friedrich LLP

(57) ABSTRACT

The disclosure provides a disposal device for receiving and storing an oral waste product. The disposal device includes a waste container having a first opening for passage of the oral waste product into and out of the container. The disposal device includes a mouthpiece having a first end, a second end, and an interior channel extending from the first end to the second end. The mouthpiece is for a user to spit the oral waste product into the first end and for the oral waste product to exit at the second end. The disposal device includes a waste tube for passage of the waste product from the mouthpiece to the waste container. The waste tube has a first opening and a second opening. The first opening is sealingly coupled to the second end of the mouthpiece. The second opening is sealingly coupled to the first opening of the waste container.

14 Claims, 8 Drawing Sheets

(56) References Cited

U.S. PATENT DOCUMENTS

| | | | | | |
|---|---|---|---|---|---|
| 4,628,547 | A * | 12/1986 | Baker | A61J 19/02 | 4/259 |
| 4,885,809 | A * | 12/1989 | Muchmore | A61J 19/02 | 4/259 |
| 4,989,275 | A * | 2/1991 | Fain | B60N 3/086 | 4/262 |
| 5,140,711 | A * | 8/1992 | Johnson | A61J 19/00 | 141/340 |
| 5,615,454 | A * | 4/1997 | Contarino | A45C 13/20 | 24/116 A |
| 6,507,957 | B1 * | 1/2003 | Ingram | A61J 19/00 | 4/259 |
| 6,665,887 | B2 * | 12/2003 | Nguyen | A61J 19/02 | 4/258 |
| 6,718,563 | B1 * | 4/2004 | Kreiensieck | A61J 19/00 | 4/258 |
| 7,121,431 | B2 * | 10/2006 | Duke | B65D 75/5883 | 222/183 |
| 7,416,078 | B2 * | 8/2008 | Willis | A24F 3/00 | 131/178 |

* cited by examiner

ORAL WASTE DISPOSAL DEVICE FOR CHEWING TOBACCO

CROSS-REFERENCE TO RELATED APPLICATIONS

This application claims priority to U.S. Provisional Patent Application No. 62/119,957, filed Feb. 24, 2015, the entire contents of which are incorporated herein by reference.

BACKGROUND

The present disclosure relates to oral waste disposal devices. In particular, the present disclosure relates to a disposal device for disposing of chewing tobacco waste (e.g., spit).

When a person uses chewing tobacco, excess saliva and tobacco juice is generated that can either be swallowed or spit out. Swallowing this saliva and juice can cause discomfort to the user and therefore, spitting of the saliva is often necessary. But spitting is both unsightly and unsanitary in most situations, therefore disposal of the saliva preferably involves some kind of container or disposal device.

SUMMARY

In one embodiment, the disclosure provides a disposal device for receiving and storing an oral waste product from a user. The disposal device includes a waste container having a first hole for passage of the oral waste product into and out of the container. The disposal device also includes a mouthpiece having a first end, a second end, and an interior channel extending from the first end to the second end. The mouthpiece is for the user to spit the oral waste product into the first end and for the oral waste product to exit at the second end. The disposal device also includes a waste tube for passage of the waste product from the mouthpiece to the waste container. The waste tube has a first opening and a second opening. The first opening is sealingly coupled to the second end of the mouthpiece. The second opening is sealingly coupled to the hole of the waste container.

In another embodiment the disclosure provides a disposal device for receiving and storing an oral waste product from a user. The device includes a waste container having a first opening and is configured for storing the oral waste product. The device also includes a mouthpiece for depositing of the oral waste product into the device by the user. The device also includes a waste tube having a first end coupled to the waste container and a second end coupled to the mouthpiece. The waste tube provides a flow path for the oral waste product from the mouthpiece to the waste container through the first opening. The device also includes a first attachment device on the waste container. The first attachment device secures the device to the user at a first attachment point. The device also includes a second attachment device coupled to one of the waste tube and the mouthpiece. The second attachment device secures the device to the user at a second attachment point remote from the first attachment point.

In yet another embodiment the disclosure provides a hands-free spitting device for a user. The device includes a waste container. The waste container includes a first clip disposed on the outside of the container and for coupling adjacent a waistline of the user, a first opening having a threaded extension, a second opening, a check valve coupled to the second opening, a rotatable member having a first end pivotally coupled to the waste container, and a second end with a twistable cap and a threaded assembly for coupling to the threaded extension. The threaded assembly has a top and a grommet with a groove configured to seat around the twistable cap. The device also includes a mouthpiece having an interior channel extending therethrough. The device also includes a waste tube having a second clip positionable along the waste tube and for coupling to the user. The waste tube has a first end coupled with a liquid tight seal to the mouthpiece and a second end coupled with a liquid tight seal to the cap. The second end of the waste tube is coupled to the top of the threaded assembly in a liquid tight seal. The mouthpiece is capable of being positioned near the mouth of a user through the positioning of the second clip and the waste tube.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
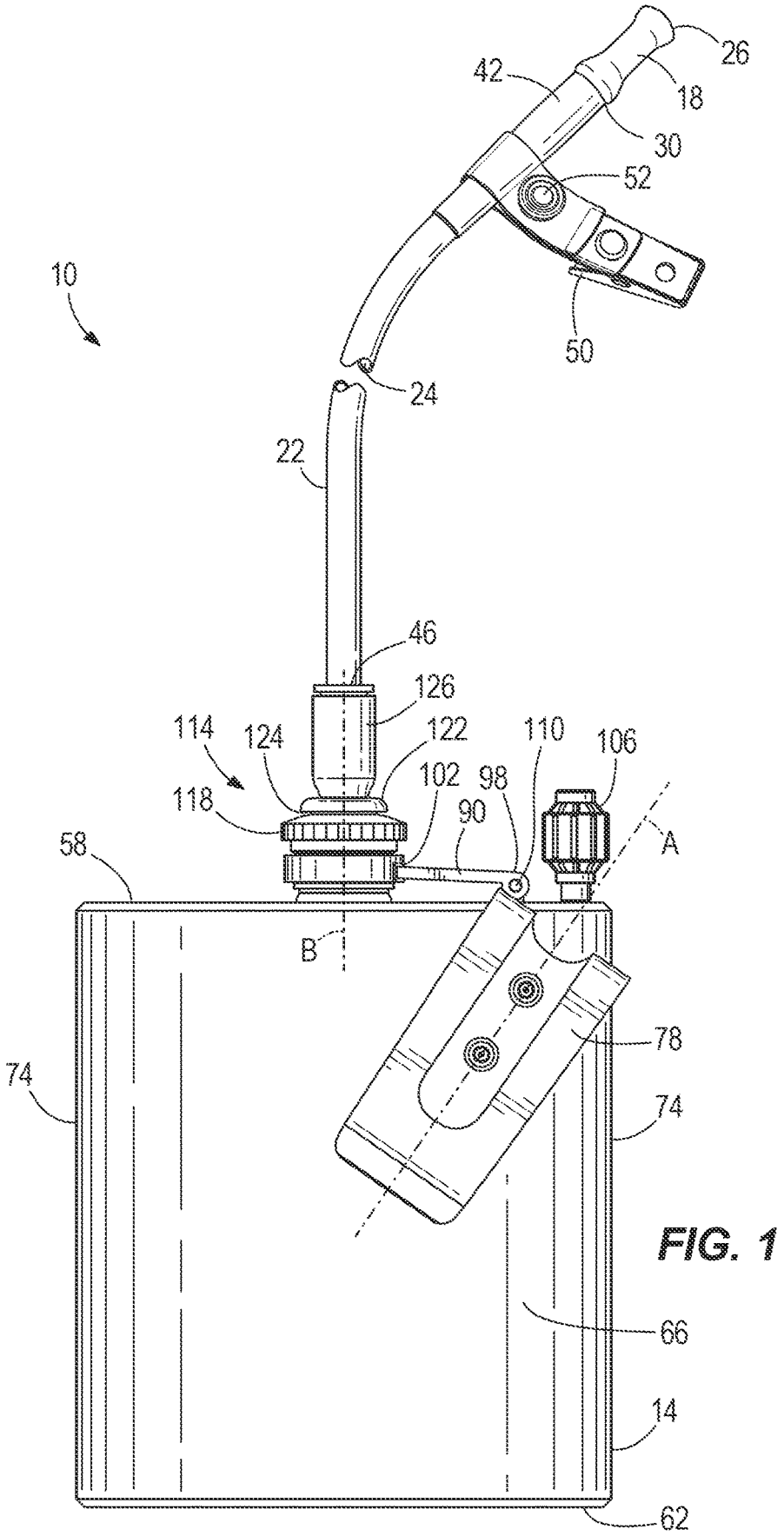
FIG. 1 illustrates a perspective, broken rear view of an oral waste disposal device for chewing tobacco according to a first embodiment of the disclosure.

FIG. 1 illustrates an oral waste disposal device 10 for chewing tobacco according to a first embodiment of the disclosure. The disposal device 10 includes a waste container 14, a mouthpiece 18, and a waste tube 22. Saliva or spit resulting from chewing tobacco is described herein as an example of oral waste for which the various embodiments of the disposal device 10 may be used. In other instances, the disposal device 10 may be used for other items spit from the mouth such as sunflower seeds or other items.

Figure 2:
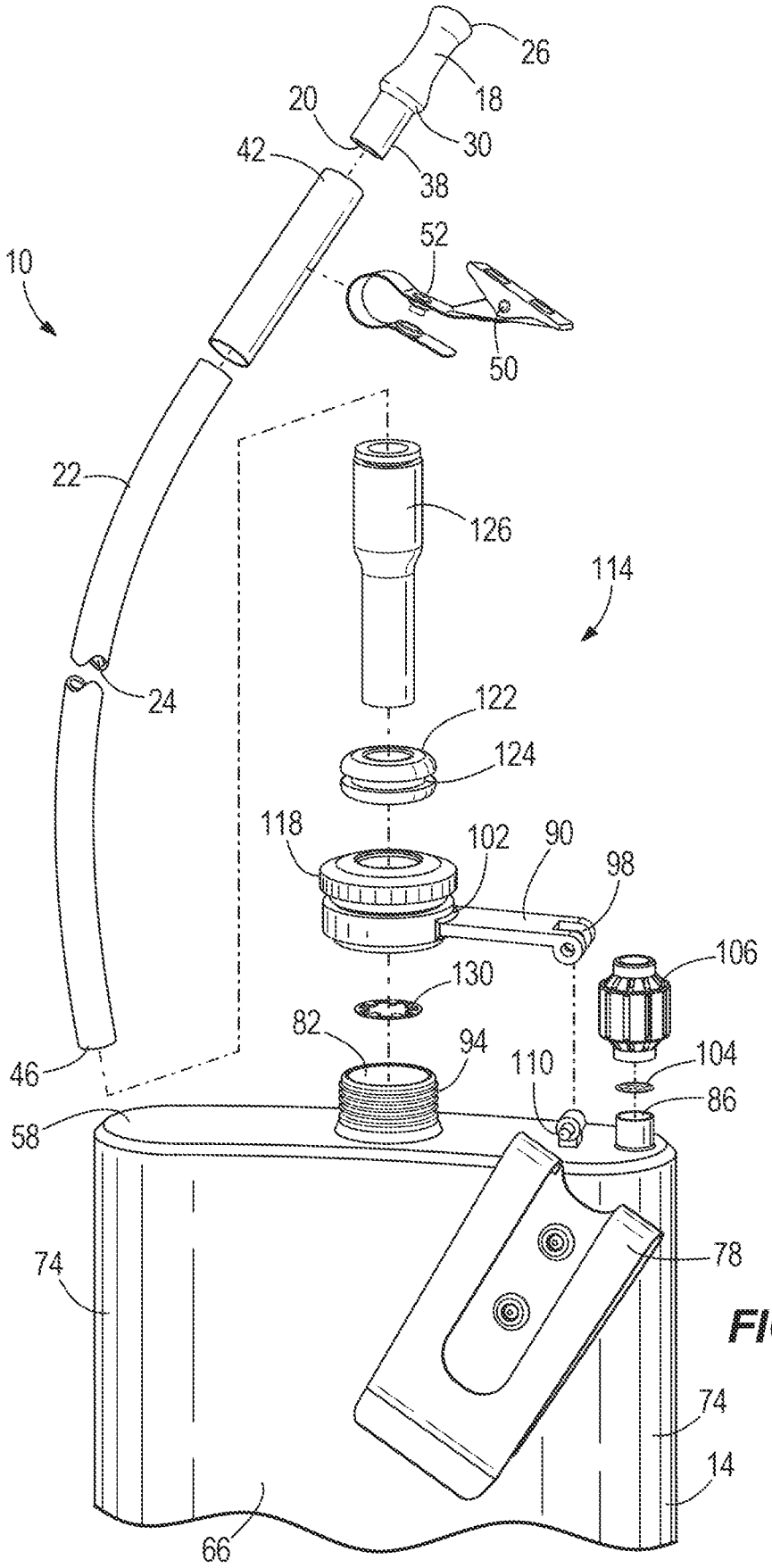
FIG. 2 illustrates an exploded, broken view of the components of the disposal device of FIG. 1.
Figure 3:
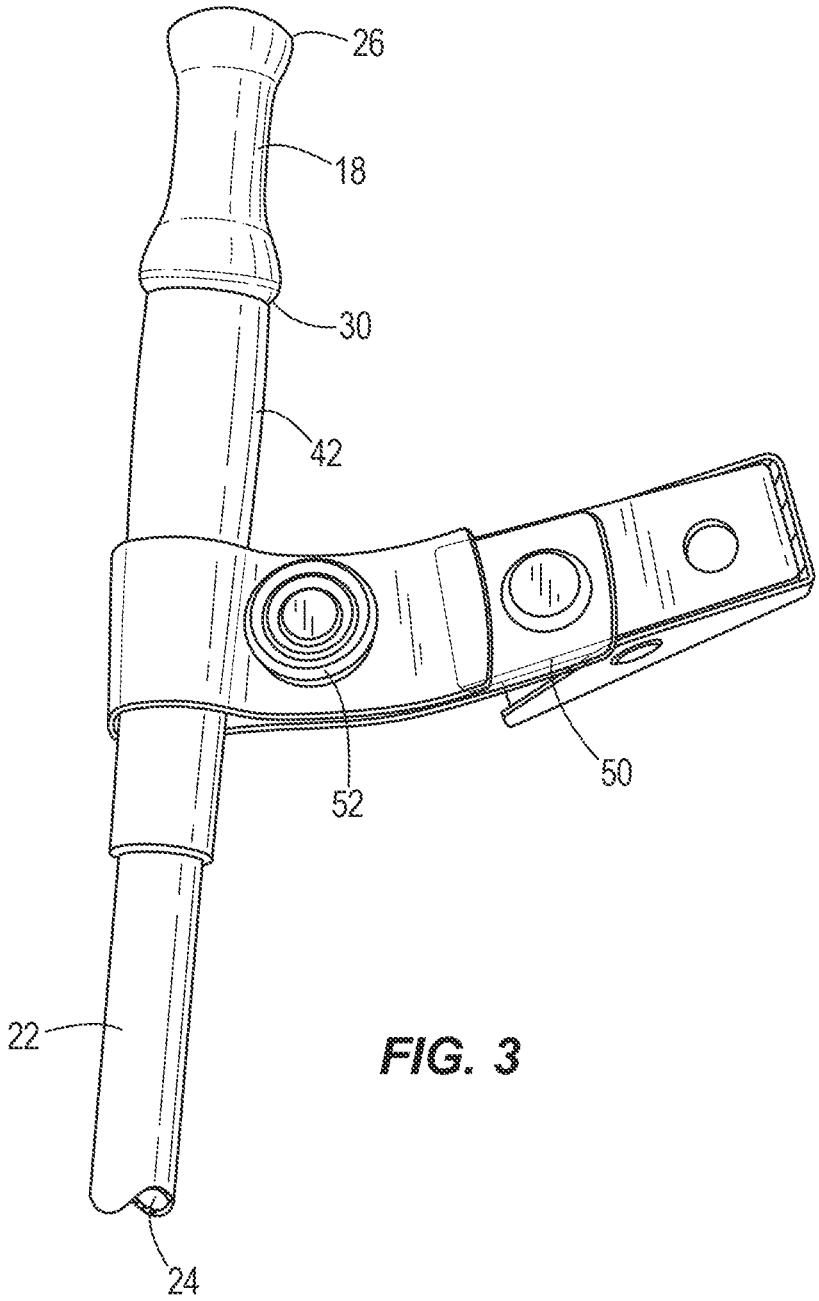
FIG. 3 illustrates a perspective view of a mouthpiece and a first clip of the disposal device of FIG. 1.
Figure 4:
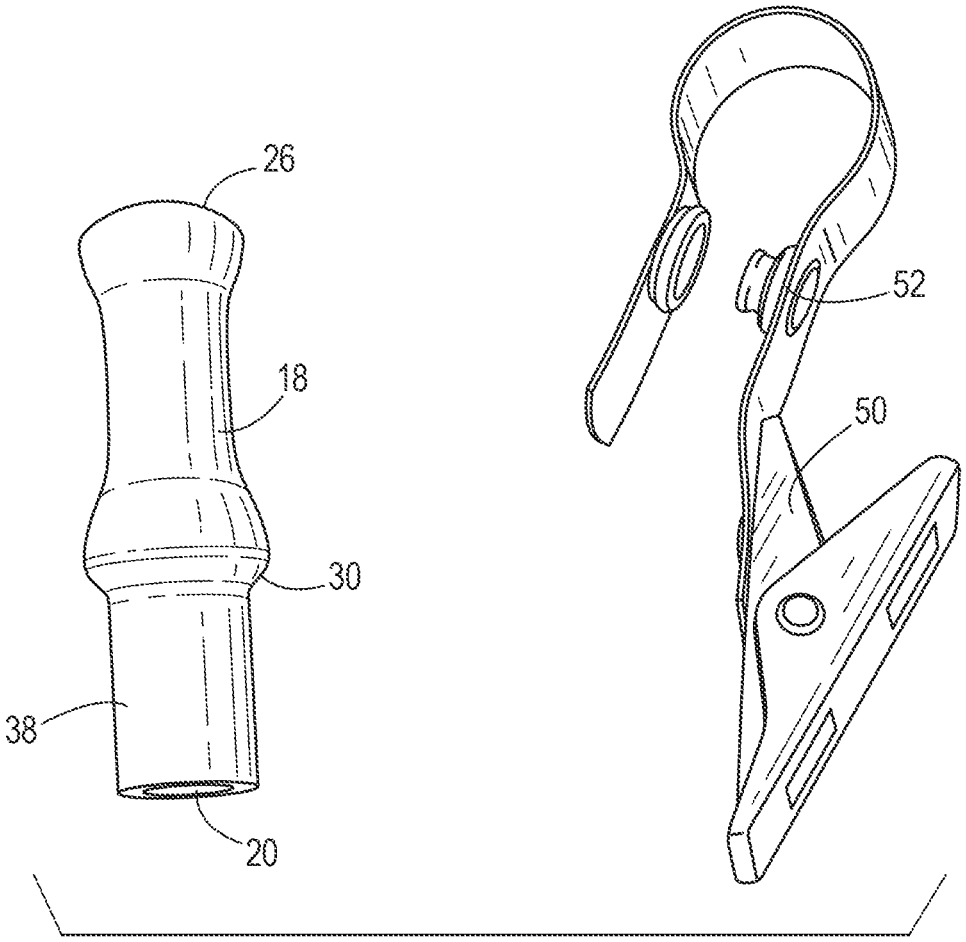
FIG. 4 illustrates perspective views of the first clip and the mouthpiece of the disposal device of FIG. 1.
Figure 5:
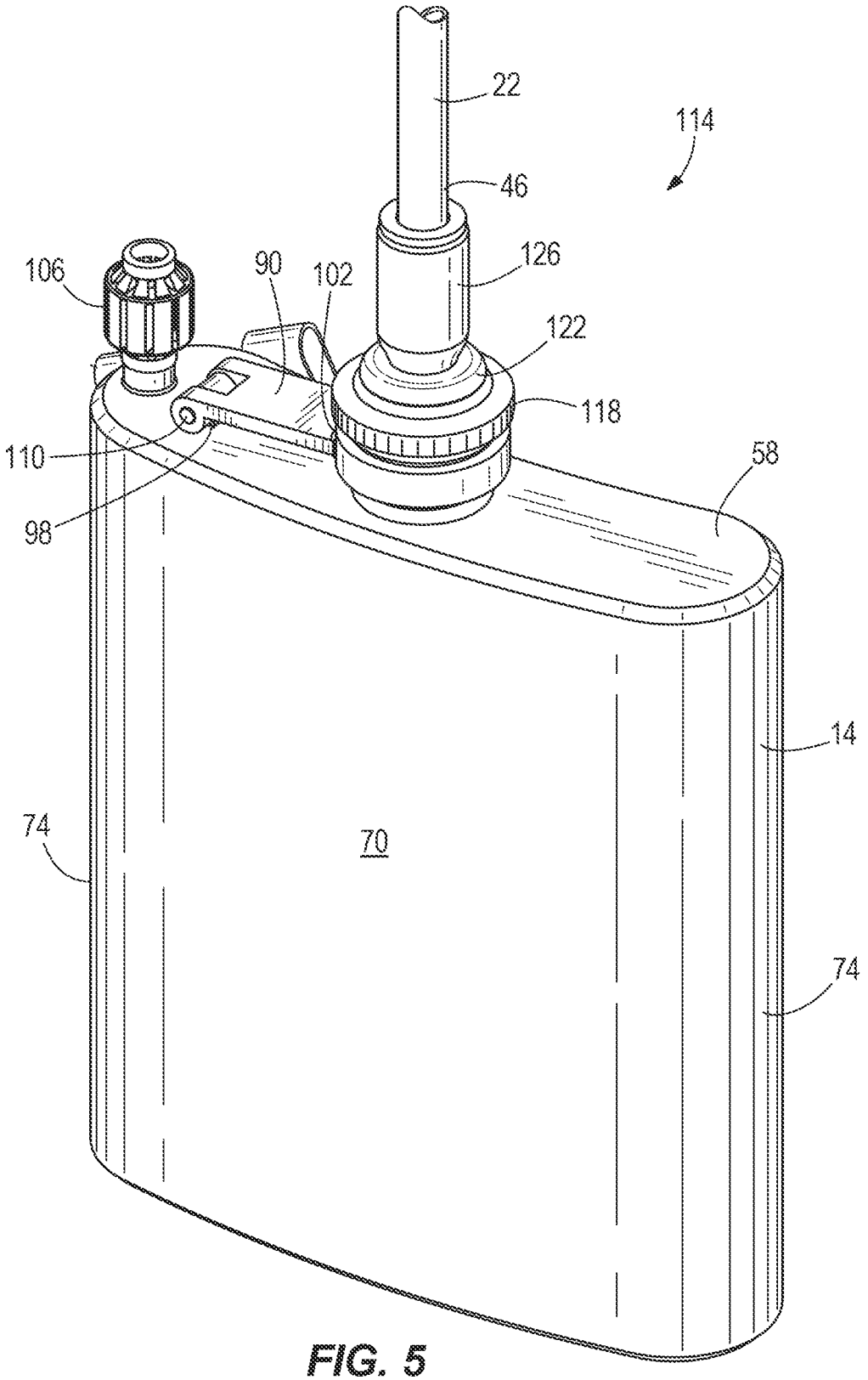
FIGS. 5 and 6 illustrate perspective views of a waste container of the disposal device of FIG. 1.
Figure 6:
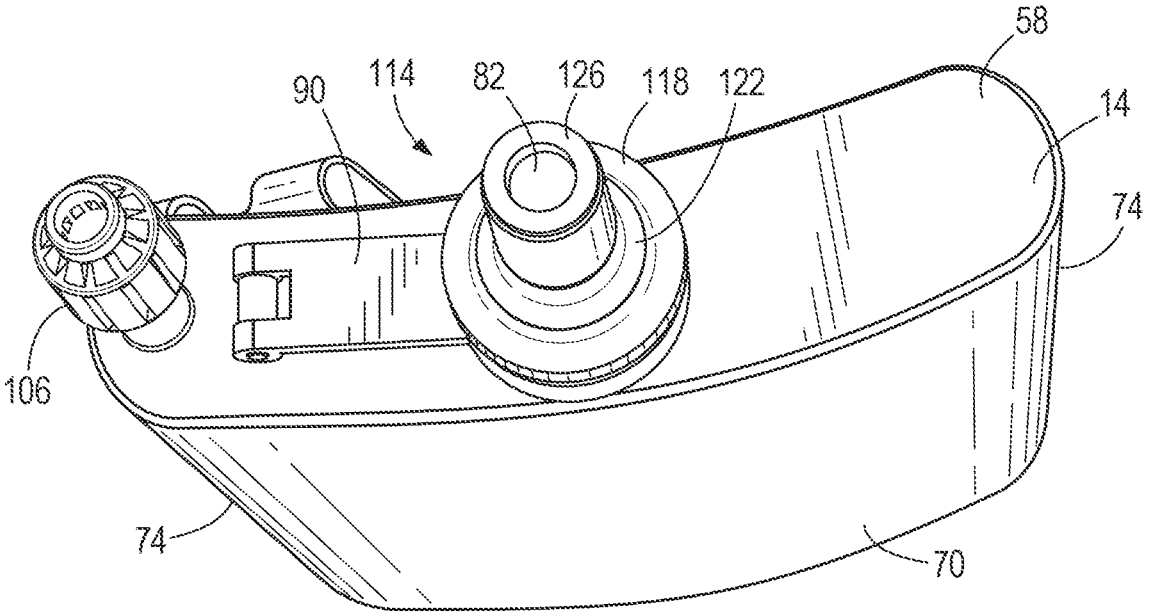

Illustrated in FIGS. 2-4, the mouthpiece 18 includes a first end 26, a second end 30, and a channel 20 that extends through the entirety of the mouthpiece 18 between the ends 26, 30. The mouthpiece 18 is ergonomically formed so that a user can easily and comfortably grip the mouthpiece 18 between the user's lips or teeth and spit the waste products into the channel 20 of the mouthpiece 18 at the first end 26. The mouthpiece 18 has an outer diameter that varies for gripping purposes. An inner diameter of the mouthpiece may be consistent, or may vary with the outer diameter. The mouthpiece 18 also includes a tip 38 that extends from the second end 30 of the mouthpiece 18. In the illustrated embodiment, the mouthpiece 18 is constructed from a hard plastic so that the mouthpiece 18 is durable.

Illustrated in FIGS. 1-3, the waste tube 22 includes a first end 42 and a second end 46, where the first end 42 is coupled to the second end 30 of the mouthpiece 18. The waste tube 22 is slightly stiff so that the waste tube 22 does not crimp easily and the flow of oral waste to the waste container 14 is not easily disrupted. The waste tube 22 should remain at least somewhat erect and hold its shape without being held by the user. The waste tube 22 is also sufficiently flexible to bend with normal actions of the user and to run under the user's clothes from the mouth of the user to the waste container 14.

The waste tube 22 further includes an adjustable first clip, or shirt clip, 50 that is configured to slide up and down the waste tube 22, after being coupled to the waste tube 22 through a button mechanism 52. The button mechanism 52 permits adjustable positioning of the first clip 50 on the waste tube 22. The first clip 50 may also be coupled to the mouthpiece 18, instead of to the waste tube 22. The first clip 50 allows the user to couple the waste tube 22 to a shirt, or another accessory on the user, adjacent a neck, sternum, or chest of the user. This way the waste tube 22 does not become uncomfortable and move about when not being held in place by the user. As the waste tube 22 is slightly stiff, the first clip 50 also allows for positioning of the mouthpiece 18 through positioning of the waste tube 22 for hands-free use of the disposal device 10. In the illustrated embodiment, the waste tube 22 is constructed from plastic tubing having a ¼ inch outer diameter. However, in other embodiments, the waste tube 22 may be constructed of tubing of other sizes or other materials. In particular, the waste tube 22 may have a larger inner diameter to allow for the disposal of waste that is not primarily liquid and which may contain larger and more viscous masses.

The mouthpiece 18 and the waste tube 22 are coupled by the waste tube 22 extending over the tip 38 of the mouthpiece 18, up to the second end 30. The fit between the waste tube 22 and the tip 38 is tight enough so that a liquid-tight seal is provided between the mouthpiece 18 and the waste tube 22. In other embodiments, the mouthpiece 18 and the waste tube 22 may be additionally coupled by a heat shrink tubing (not pictured). The heat shrink tubing then provides an additional means of keeping the waste tube 22 and the mouthpiece 18 together. Specifically, the heat shrink tubing is placed over the first end 42 of the waste tube 22 and over a portion of the mouthpiece 18 and heated until the heat shrink tubing has shrunk to the point of creating a liquid-tight seal between the mouthpiece 18 and the waste tube 22. In yet other embodiments, the waste tube 22 may extend directly to and possibly into the mouthpiece 18, without an intervening tip 38 or heat shrink tubing. In yet other embodiments, the mouthpiece 18 and the waste tube 22 may be formed as a one-piece assembly.

As illustrated in FIGS. 1, 2, and 5-7, the waste container 14 is a one-piece, stainless steel flask for use as a container for tobacco spit and already chewed chewing tobacco. The one-piece, stainless steel design provides a solid and durable construction. The waste container 14 includes a first side 58, a second side 62, a third side 66, a fourth side 70, and two connecting sides 74 connecting the fourth side 70 and the third side 66. The third side 66, the fourth side 70, and the two connecting sides 74 each extend from the first side 58 to the second side 62. The third side 66 of the waste container 14 includes a second clip, or belt clip, 78 configured to attach the waste container 14 to a belt, pocket, pants, shirt, or another area of the user's choice adjacent a waistline of the user. In the illustrated embodiment, the second clip 78 defines a first axis A and is riveted to the waste container 14. In other embodiments, the second clip 78 may be molded with the waste container 14, welded to the waste container 14, or fastened to the waste container 14 in other ways as known in the art.

Figure 7:
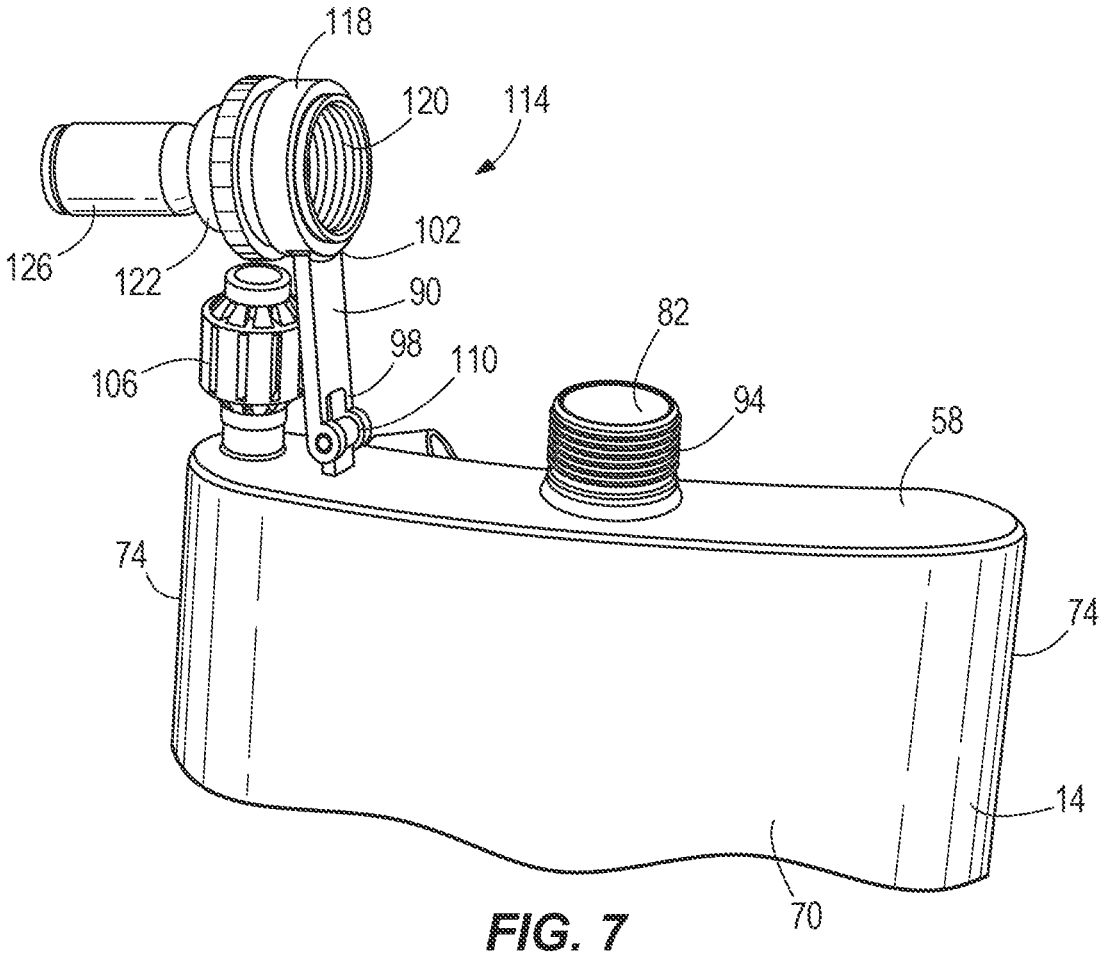
FIG. 7 illustrates a perspective view of the waste container of FIG. 5 including a rotatable member in a fully open position.

The first side 58 of the waste container 14 includes two openings or ports 82, 86 and a rotatable member 90. The first opening 82 defines a second axis B, positioned near the center of the first side 58, is a relatively small opening and includes a threaded extension 94, as illustrated in FIG. 7. The first opening 82 allows for spit to enter into the waste container 14 from the waste tube 22 and also permits emptying the contents of the waste container 14 for cleaning or regular and timely disposal. The second opening 86 acts as a vent for the disposal device 10 and may include a screen 104 and a check valve 106. The rotatable member 90 includes two ends 98, 102. The first end 98 is rotatably fixed to the first side 58 of the waste container 14 and defines a pivot point 110 of the rotatable member 90. The rotatable member 90 is pivotable about the pivot point 110 between a first position, illustrated in FIGS. 1, 5, and 6, and a second, or fully open, position, illustrated in FIG. 7. The second end 102 of the rotatable member 90 includes a threaded assembly 114 that is capable of being turned for coupling to the threaded extension 94 of the first opening 82.

Figure 9:
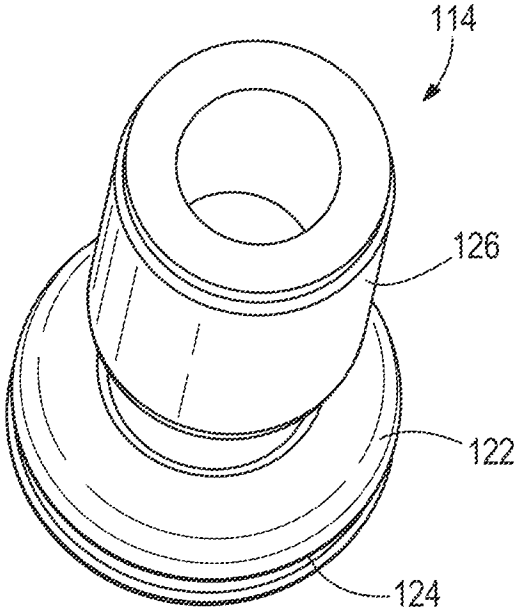
FIG. 9 illustrates a top perspective view of the quick release assembly of FIG. 8.
Figure 8:
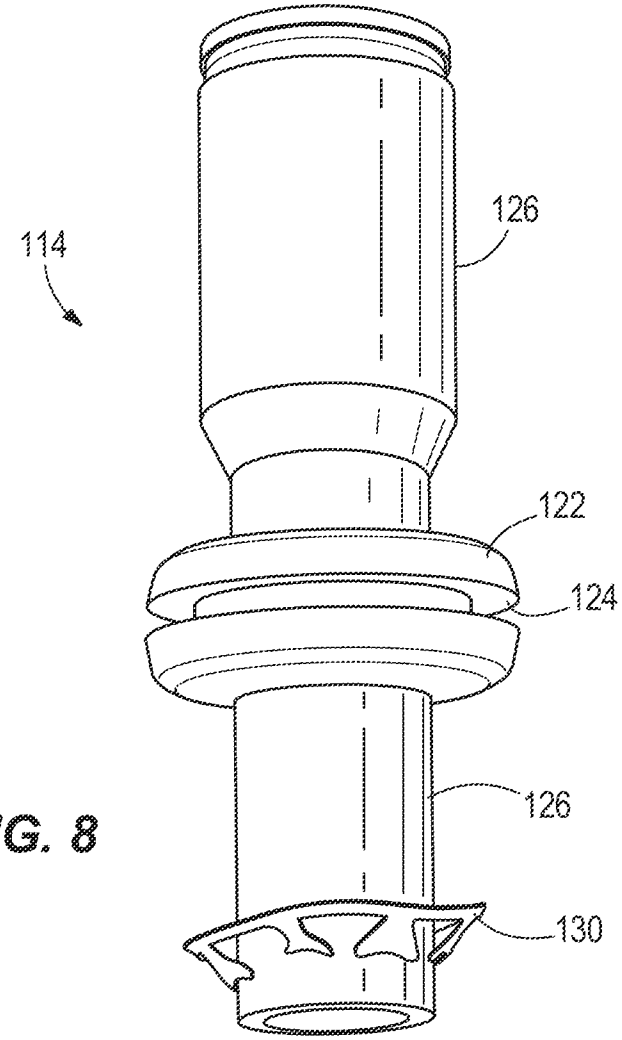
FIG. 8 illustrates a side perspective view of the quick release assembly of the disposal device of FIG. 1.
Figure 10:
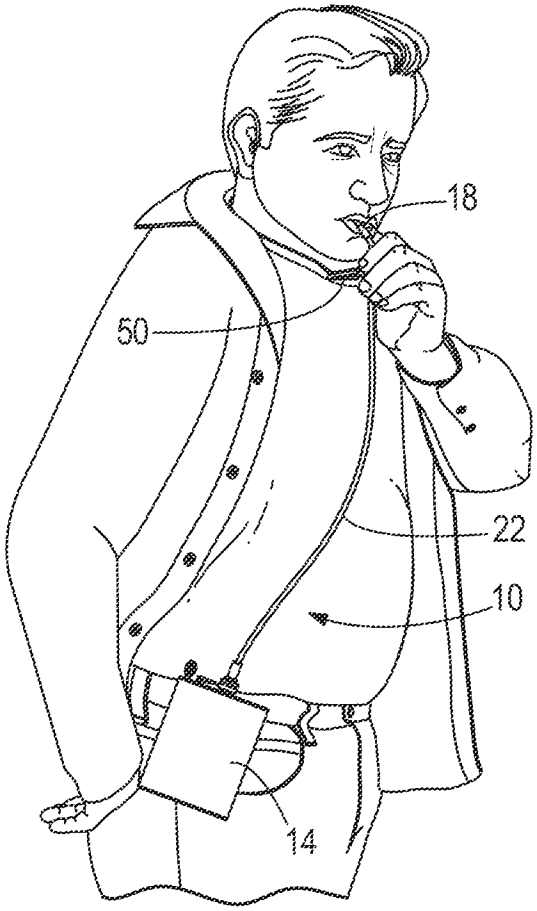
FIG. 10 illustrates a perspective view of a person wearing and using the disposal device of FIG. 1.

The threaded assembly 114 of the rotatable member 90 includes a cap 118, a grommet 122, a quick release member 126, and a lock ring 130. The cap 118 includes internal threads 120 that mesh with the threaded extension 94. This way, the cap 118 is twistable so as to couple and uncouple the threaded assembly 114 to the threaded extension 94, and the rotatable member 90 is free to move between the first position and the second position. As illustrated in FIGS. 8-10, the second end 46 of the waste tube 22 can be inserted and removed from the threaded assembly 114. Specifically, the quick release member 126 allows for easy insertion and removal of the waste tube 22 into the threaded assembly 114. The quick release member 126 also provides a liquid tight seal between the second end 46 of the waste tube 22 and the threaded assembly 114 of the waste container 14. The grommet 122 includes a groove 124 and is positioned within the cap 118. The grommet 122 is seated within the cap 118, specifically so that the cap 118 is seated about the groove 124. The grommet 122 provides a liquid tight seal between the quick release member 126 of the threaded assembly 114 and the threaded extension 94 of the waste container 14, after the threaded assembly 114 is tightened on the threaded extension 94 by twisting the cap 118. The lock ring 130 is at an end of the threaded assembly 114 adjacent the cap 118. In the illustrated embodiment, the lock ring 130 is within the cap 118 and sized so that inadvertent removal of the quick release member 126 is prevented when removing the waste tube 22 from the quick release member 126. In other embodiments, the lock ring 130 may be within the waste container 14 and sized so that inadvertent removal of the quick release member 126 from the threaded assembly 114 is not likely.

As assembled, the waste container 14 is coupled to the second end 46 of the waste tube 22 through the quick release member 126 of the threaded assembly 114. Specifically, the waste tube 22 is inserted into the quick release member 126. As explained previously, the first end 42 of the waste tube 22 is coupled to the second end 30 of the mouthpiece 18. When coupled to the threaded extension 94, the threaded assembly 114 provides a flow path from the waste tube 22 to the first opening 82 of the waste container 14. However, the threaded assembly 114 may be detached from the threaded extension 94 by twisting the cap 118 so that the first opening 82 is open to the atmosphere, as illustrated in FIG. 7. Therefore, the flow path from the user's mouth permits oral waste entering the channel 20 at the first end 26 of the mouthpiece 18 to flow through the channel 20, exit the channel 20 at the second end 30 of the mouthpiece 18, and enter the first end 42 of the waste tube 22. The oral waste flows through the waste tube 22 where it exits the second end 46 of the waste tube 22 and passes into the threaded assembly 114 and finally enters the waste container 14. In the illustrated embodiment, the second end 46 of the waste tube 22 ends prior to entering the waste container 14, but in other embodiments, the waste tube 22 may extend into the waste container 14, through the quick release member 126 and the grommet 122. The second opening 86 allows for a continuous flow of fluid through the disposal device 10. The check valve 106 seals the second opening 86 when a user is not spitting into the disposal device 10, but will open when the user is spitting into the disposal device 10.

Figure 11:
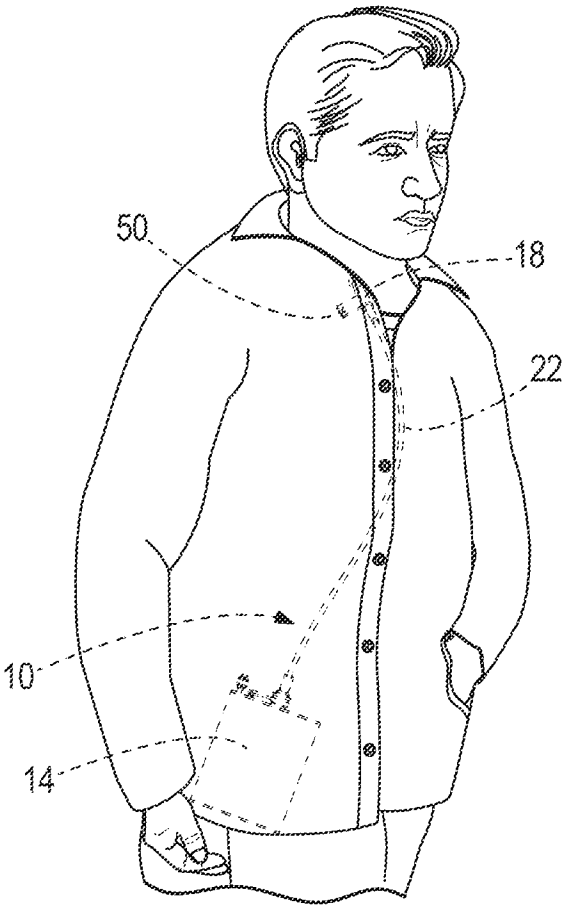
FIG. 11 illustrates a perspective view of the person of FIG. 10 wearing the disposal device of FIG. 1 in a manner in which the disposal device is substantially hidden from view.
Figure 12:
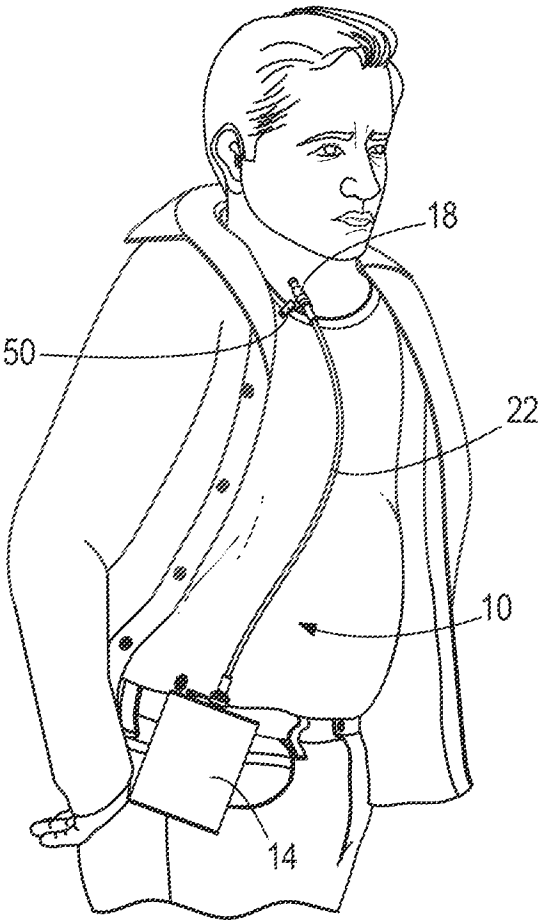
FIG. 12 illustrates a perspective view of the person of FIG. 10 wearing the disposal device of FIG. 1 in a manner in which the disposal device is not substantially hidden from view.

When worn by a user, as illustrated in FIGS. 10-12, the disposal device 10 is secured to the user at two points. The first securing point may be at the belt area of the user through the second clip 78, whereas the second securing point may be on the shirt of the user through the first clip 50. The second clip 78 is positioned at angle relative to the waste container 14 (e.g., the first axis A is angled relative to the second axis B). In other embodiments, the second clip 78 may be aligned with the waste container 14 so that the first axis A is parallel to, or aligned with the second axis B. By placing the first clip 50 near or on the mouthpiece 18, a user may use the disposal device 10 hands-free by simply moving the user's mouth toward the mouthpiece 18. The disposal device 10 may be substantially hidden behind a jacket, shirt, or some other covering, accessory, or clothing, as illustrated in FIG. 11. When the user is done with chewing tobacco, the user may detach the threaded assembly 114 from the threaded extension 94 by twisting the cap 118 so the rotatable member 90 may be rotated toward the second opening 86. The first opening 82 is now accessible so that a user may discard the chewing tobacco within the waste container 14. Similarly, to empty the waste container 14, the threaded assembly 114 is detached from the threaded extension 94 by twisting the cap 118, and the waste contents of the waste container 14 may be poured out.

Furthermore, the first opening 82 may be sufficiently large to provide for easy removal of the waste contents of the waste container 14 or, when the user is done with the chewing tobacco, for directly disposing the chewing tobacco into the waste container 14. In some embodiments, the waste container 14 may not have the second opening 86, or the check valve 106 (i.e., providing a direct opening to the atmosphere from the waste container 14), or the second opening 86 and the check valve 106 may be at other locations on the waste container 14.

Instead of stainless steel, the waste container 14 may be composed of other materials, such as aluminum, rubber, or plastic. The waste container 14 may also be shaped in any fashion suitable for containing oral waste products (e.g., spit, tobacco, etc.). Additionally, the waste container 14 may be a two-piece design (not pictured). In that design, a first (i.e., top) section and a second (i.e., bottom) section may be coupled together by a threaded connection, a frictional fit (i.e., push fit or exact fit) connection, or by any other suitable fashion. The two piece design would provide a much larger opening, to allow for complete removal of all the contents of the waste container 14, as well as providing easy access to the waste container 14 for cleaning.

Various features and advantages of the disclosure are set forth in the following claims.

What is claimed is:

1. A disposal device for receiving and storing an oral waste product from a user, the disposal device comprising:

a waste container including a first opening for passage of the oral waste product into and out of the container, and wherein the waste container also includes a threaded extension providing a passage to the first opening;

a cap threadably couplable to the threaded extension of the waste container;

a quick release member coupled to the cap and in fluid communication with the first opening;

a mouthpiece including a first end, a second end, and an interior channel extending from the first end to the second end, wherein the interior channel has a consistent diameter throughout its length, the mouthpiece for the user to spit the oral waste product into the first end and for the oral waste product to exit at the second end, and wherein the mouthpiece is ergonomically formed for gripping between the user's lips or teeth;

a waste tube for passage of the waste product from the mouthpiece to the waste container, the waste tube including a third opening and a fourth opening, wherein the third opening is sealingly coupled to the second end of the mouthpiece, and the fourth opening is removably coupled to the quick release member, and wherein the quick release member allows for insertion and removal of the fourth opening of the waste tube therefrom, and wherein the quick release member and the second end of the waste tube together form a liquid tight seal when the waste tube is inserted therein; and a rotatable member having a first end pivotally coupled to the waste container at a pivot point spaced from the threaded extension, and a second end coupled to the cap, the rotatable member being rotatable about the pivot point between a first position and a second position.

2. The disposal device according to claim 1, the disposal device further comprising a first clip on the outside of the waste container and for coupling to the user, near the user's waistline.

3. The disposal device according to claim 2, the disposal device further comprising a second clip positionable along the waste tube or the mouthpiece, and for coupling to the user, near the user's neck or sternum, and wherein the second clip is configured to slide up and down the waste tube after being coupled thereto.

4. The disposal device according to claim 3, wherein the mouthpiece is capable of being positioned near the mouth of a user through the positioning of the second clip and the waste tube.

5. The disposal device according to claim 1, the waste container further including a second opening having a check valve and a screen.

6. The disposal device according to claim 5, wherein when the rotatable member is in the first position a continuous flow path is provided between the mouth piece and the waste container, and when the rotatable member is in the second position a user has access to the first opening of the waste container to discard its contents.

7. The disposal device according to claim 1, further comprising a release member, a grommet with a groove, and wherein the cap seats around the groove of the grommet.

8. The disposal device according to claim 1, wherein the waste tube extends between the mouthpiece and the waste container when the mouthpiece is positioned near the mouth of the user and the waste container is positioned near the waist of the user.

9. A disposal device for receiving and storing an oral waste product from a user, the device comprising:

a waste container including a first opening and configured for storing the oral waste product, the first opening defining a first axis, and wherein the waste container also includes a threaded extension coaxial with the first opening and providing a passage to the first opening;

a cap threadably coupled to the threaded extension of the waste container;

a mouthpiece for depositing of the oral waste product into the container by the user, wherein the mouthpiece includes an interior channel having a consistent diameter throughout its length, and wherein the mouthpiece is ergonomically formed for gripping between the user's lips or teeth;

a waste tube including a first end coupled to the cap and a second end coupled to the mouthpiece, the waste tube providing a flow path for the oral waste product from the mouthpiece to the waste container through the first opening;

a first attachment device on the waste container, wherein the first attachment device secures the device to the user at a first attachment point;

a second attachment device coupled to the waste tube, wherein the second attachment device secures the device to the user at a second attachment point remote from the first attachment point, and wherein the second attachment device is configured to slide up and down the waste tube after being coupled thereto; and a rotatable member having a first end pivotally coupled to the waste container at a pivot point spaced from the first axis, and a second end coupled to the cap and in fluid communication with the first opening, the rotatable member being rotatable about the pivot point between a first position and a second position.

10. The disposal device according to claim 9, wherein the first attachment device is a clip attached to the waste container, whose longitudinal axis is positioned at an angle relative to an axis that extends longitudinally through the first opening.

11. The disposal device according to claim 9, wherein the flow path from the mouthpiece to the waste container includes liquid tight couplings between the first end of the waste tube and the waste container and between the second end of the waste tube and the mouthpiece.

12. The disposal device according to claim 9, the waste container further including a second opening having a check valve and a screen.

13. The disposal device according to claim 9, further comprising a release member, a grommet with a groove, and wherein the cap seats around the groove to provide a liquid tight seal between the first end of the waste tube and the waste container.

14. A hands-free spitting device for a user comprising:

a waste container including a first clip disposed on the outside of the container and for coupling adjacent a waistline of the user, a first side, a threaded extension extending from the first side to define a first axis and a first opening therethrough, a second opening, a check valve coupled to the second opening, a cap threadably couplable to the threaded extension, a quick release member coupled to the cap and in fluid communication with the first opening;

a grommet with a groove, the cap seated within the groove, and the quick release member extending through the grommet, the cap, and into the threaded extension, and wherein the grommet forms a liquid tight seal between the quick release member and the cap, a rotatable member having a first end pivotally coupled at a pivot point on the first side and defining a second axis transverse to the first axis, and a second end coupled to the cap, and wherein the threaded extension is spaced from the pivot point a mouthpiece including a channel extending therethrough; and a waste tube including a second clip positionable along the waste tube and for coupling to the user, the waste tube having a first end coupled with a liquid tight seal to the mouthpiece, and a second end coupled to the quick release member, and wherein the quick release member allows for insertion and removal of the second end of the waste tube therefrom, and wherein the quick release member and the second end of the waste tube together form a liquid tight seal when the waste tube is inserted therein;

wherein the mouthpiece is capable of being positioned near the mouth of a user through the positioning of the second clip and the waste tube, and wherein the channel has a consistent diameter throughout its length, and wherein the mouthpiece is ergonomically formed for gripping between the user's lips or teeth;

wherein the second clip is configured to slide up and down the waste tube after being coupled thereto.

* * * * *